US009459593B2

(12) United States Patent
Miwa et al.

(10) Patent No.: US 9,459,593 B2
(45) Date of Patent: Oct. 4, 2016

(54) ELECTRONIC DEVICE

(71) Applicant: CASIO COMPUTER CO., LTD., Shibuya-ku, Tokyo (JP)

(72) Inventors: Jun Miwa, Higashiyamato (JP); Takashi Sano, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 119 days.

(21) Appl. No.: 14/180,214

(22) Filed: Feb. 13, 2014

(65) Prior Publication Data

US 2014/0233357 A1 Aug. 21, 2014

(30) Foreign Application Priority Data

Feb. 15, 2013 (JP) ..... 2013-027210

(51) Int. Cl.

| | |
|---|---|
| ***G04R 60/00*** | (2013.01) |
| ***G04R 20/12*** | (2013.01) |
| ***G04G 9/08*** | (2006.01) |
| ***G04R 60/12*** | (2013.01) |
| ***G04G 17/06*** | (2006.01) |

(52) U.S. Cl.

CPC ..... *G04R 20/12* (2013.01); *G04G 9/08* (2013.01); *G04G 17/06* (2013.01); *G04R 60/12* (2013.01)

(58) Field of Classification Search

CPC ..... G04R 60/00; G04R 60/06; G04R 60/10; G04R 60/12

USPC ..... 343/718

See application file for complete search history.

(56) References Cited

U.S. PATENT DOCUMENTS

| | | | | |
|---|---|---|---|---|
| 5,696,518 | A * | 12/1997 | Itoh et al. | 343/718 |
| 6,134,188 | A * | 10/2000 | Ganter et al. | 368/47 |
| 7,091,916 | B2 * | 8/2006 | Paratte | 343/718 |
| 7,167,134 | B2 * | 1/2007 | Minami et al. | 343/718 |
| 7,215,600 | B1 * | 5/2007 | DeRosa | 368/10 |
| 7,385,874 | B2 * | 6/2008 | Vuilleumier et al. | 368/10 |
| 8,072,844 | B2 * | 12/2011 | Miyahara | G04G 21/04 343/788 |
| 2005/0018543 | A1 * | 1/2005 | Fujisawa | G04G 5/002 368/47 |
| 2006/0109188 | A1 * | 5/2006 | Ikeda et al. | 343/718 |

(Continued)

FOREIGN PATENT DOCUMENTS

| | | |
|---|---|---|
| JP | 2010-273231 A | 12/2010 |
| JP | 2012-058161 A | 3/2012 |

*Primary Examiner* — Amy Cohen Johnson
*Assistant Examiner* — Jason Collins
(74) *Attorney, Agent, or Firm* — Holtz, Holtz & Volek PC

(57) ABSTRACT

An electronic device includes a display section, at least one substrate, a control section, a connecting section, a receiving section, and output wiring. The at least one substrate includes a plurality of wiring layers overlapped as a whole. Output wiring is provided on the first layer among the plurality of wiring layers and connects each of the plurality of the output terminals and the control section. From a planar view of the substrate, a bar antenna is attached on a face of a second layer on a side opposite of the first layer, in a position between positions corresponding to positions of the connecting section and the control section. The output wiring crosses between regions corresponding to both edge regions including both edges of the bar antenna.

21 Claims, 7 Drawing Sheets

(56) References Cited

U.S. PATENT DOCUMENTS

2007/0109208 A1* 5/2007 Turner ..... 343/718
2007/0152900 A1* 7/2007 Takada ..... 343/788
2007/0159928 A1* 7/2007 Nirasawa ..... 368/47
2007/0210975 A1* 9/2007 Someya et al. ..... 343/788
2009/0231960 A1* 9/2009 Hutcheson ..... G04G 17/04 368/10
2011/0051561 A1* 3/2011 Fujisawa ..... 368/47
2012/0252373 A1* 10/2012 Saito et al. ..... 455/73

* cited by examiner

ELECTRONIC DEVICE

BACKGROUND OF THE INVENTION

1. Field of the Invention

The present invention relates to an electronic device which includes a digital display screen and which is able to receive a radio wave.

2. Description of the Related Art

Conventionally, there is an electronic timepiece (radio-controlled timepiece) which receives a radio wave in a long wavelength band (standard radio wave) including time information and obtains time data to be able to calibrate the held time information. In such radio-controlled timepieces, the present time is calibrated at a predetermined cycle or calibrated based on operation by the user so as to be able to maintain display of accurate time.

In a radio-controlled timepiece, a small antenna for receiving the standard radio wave is provided inside the casing. A bar antenna is preferably used as the small antenna. However, most electronic circuits and electronic components generate noise in a long wavelength band, and the noise from the adjacent wiring and electronic components tend to be mixed when the standard radio wave is received. Specifically, in small radio-controlled timepieces such as watches, the electronic components, wiring and antenna need to be provided closely, and the problem of the noise mixing appears significantly.

In view of the above, Japanese Patent Application Laid-Open Publication No. 2010-273231 discloses a technique where the edge of the substrate is cut to provide a space for the antenna so that there is a distance from the antenna to the wiring and the electronic components on the substrate while maintaining a compact size. Alternatively, Japanese Patent Application Laid-Open Publication No. 2012-58161 describes providing an antenna on the rear face of the edge of the substrate with a shield electrode in between, so that the reception level of the noise decreases.

However, when an electronic device which receives radio waves includes a digital display screen such as a liquid crystal display (LCD), connectors for the output terminal are provided on both edges of the substrate, and the desired display is achieved by driving the voltage of the pixels or the segments of the display screen provided between the connectors. Therefore, if the edge of the substrate is cut as in the technique described in Japanese Patent Application Laid-Open Publication No. 2010-273231, the area of the display screen becomes small in the cut amount. As for the technique described in Japanese Patent Application Laid-Open Publication No. 2012-58161 where the antenna is provided on the rear face of the edge of the substrate, the width of the connector needs to be less than the length of the antenna, and it is not possible to increase the output terminals. Therefore, it is difficult to provide a display screen with a high resolution which includes a large number of output terminals, or a display screen of a dot matrix method.

The present invention is an electronic device which can receive radio waves preferably while setting the size and the resolution of the display screen to a large setting.

SUMMARY OF THE INVENTION

According to an aspect of the present invention, there is provided an electronic device including:

a display section which executes digital display;

one substrate or a plurality of substrates arranged in a thickness direction, the one substrate or the plurality of substrates including a plurality of wiring layers overlapped as a whole;

a control section which is attached to a first layer among the plurality of wiring layers and which controls display of the display section;

a connecting section which is provided on the first layer and in which a plurality of output terminals connected to the display section are arranged;

a receiving section which includes a bar antenna to receive a radio wave; and output wiring which is provided on the first layer and which connects each of the plurality of the output terminals and the control section, wherein from a planar view of the substrate, the bar antenna is attached on a face of a second layer on a side opposite of the first layer, in a position between positions corresponding to positions of the connecting section and the control section, the second layer which is a wiring layer of either edge layer of the plurality of wiring layers and which is different from the first layer;

the output wiring connected to the connecting section and the output terminal is provided on the first layer so as to cross between regions corresponding to both edge regions including both edges of the bar antenna; and the region between the both edge regions on the second layer is a shielding region provided with a magnetic shielding section.

BRIEF DESCRIPTION OF THE DRAWINGS

The present invention and the above-described objects, features and advantages thereof will become more fully understood from the following detailed description with the accompanying drawings and wherein.

DETAILED DESCRIPTION OF THE PREFERRED EMBODIMENTS

Below, an embodiment of the present invention is described with reference to the drawings.

Figure 1:
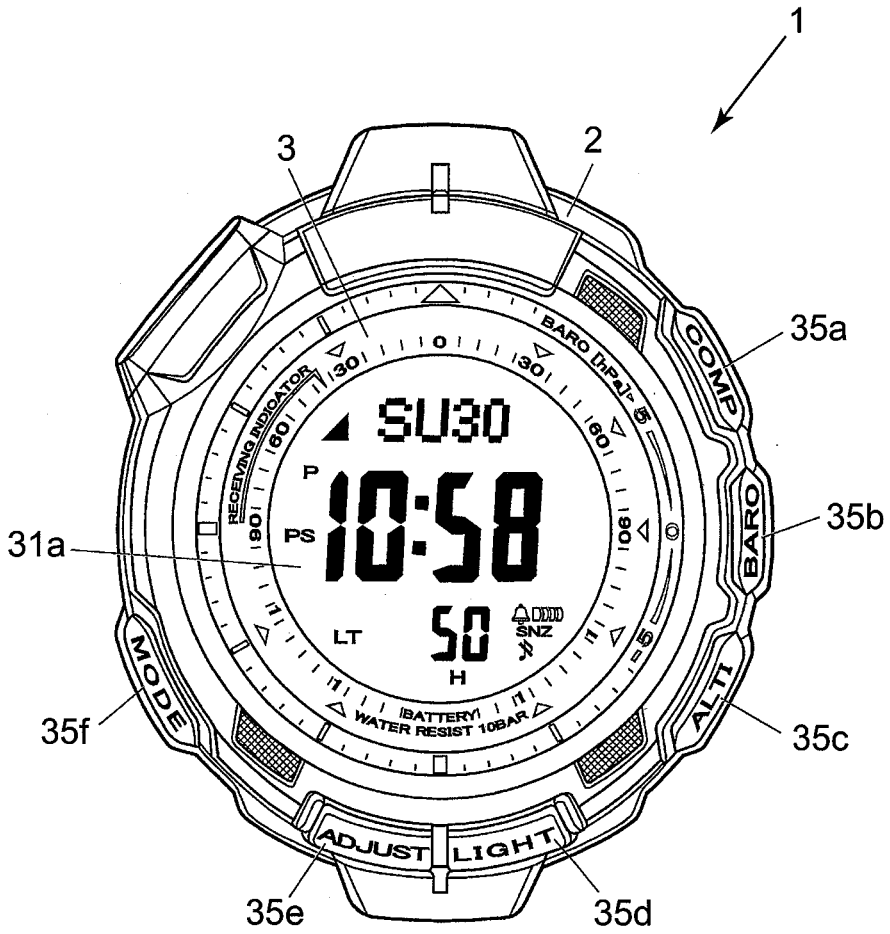
FIG. 1 is a diagram showing a front view of an electronic timepiece of an embodiment of the present invention.

FIG. 1 is a diagram showing a front view of an electronic timepiece 1 of an embodiment of an electronic device of the present invention.

The electronic timepiece 1 is a watch type which can be worn on an arm of a user using a band which is not shown. A display screen 31*a* which is a digital display is provided in a center of an upper face (face on a side which does not come into contact with the arm of the user) of a circular casing 2. A bezel 3 provided with a scale and a label regarding various functions which can be performed by the electronic timepiece 1 is provided around the display screen 31*a*. Press button switches 35*a* to 35*f* are provided on a side face of the casing 2.

According to the electronic timepiece 1 of the present embodiment, the casing 2 is formed from conductive metal material such as stainless steel. A lower face (face on side which comes into contact with the arm of the user) of the casing 2 is covered by a back cover which is not shown. A later described four-layer substrate 6 and an antenna 33 are provided and stored in order between the display screen 31*a* and the bezel 3, and the back cover.

The bezel 3 can be conductive metal material such as stainless steel or insulating material such as rubber material. The bezel 3 functions as a frame member which holds the display section 31 including the display screen 31*a* fitted in the frame and fixes the display section 31 to the casing 2.

A label showing the corresponding function is provided in each press button switch 35*a* to 35*f*. Press button switches 35*a* to 35*d* are each provided with a label "COMP" showing a direction display function, a label "BARO" showing a pressure display function, a label "ALTI" showing an altitude display function, and a label "LIGHT" showing lighting of illumination. Press button switches 35*e* and 35*f* are each provided with a label "ADJUST" showing the button is used for adjusting setting of various functions, and a label "MODE" showing switching of various functions.

The display screen 31*a* of the present embodiment is a digital display screen of a liquid crystal display. Three display regions consisting of an upper region, a middle region and a lower region are provided in the display screen 31*a*, and contents of display can be combined to enable various displays. In a basic display state shown in FIG. 1, an indicator showing reception level of the radio-controlled timepiece, day of week and date are displayed in the upper region of the display section 31*a*. AM/PM (here, "P" showing PM), time (here, 10:58), and display "PS" showing the device is in a mode which advances to a power save mode according to predetermined conditions based on a value measured by a later described illuminating degree sensor 56 (see FIG. 2) are displayed in the middle region of the display section 31*a*. Display "LT" showing the device is in an auto-light mode which lights an EL element 37*a* when it is detected that a display face is in an inclining angle of a predetermined range based on a value measured by a later described accelerating degree sensor 58 (see FIG. 2), second of present time (here, 50 seconds), state of battery (here, display "H" showing high level), and display regarding setting of noise for an alarm function, etc. (here, time tone: on, alarm notification: on, snooze function: on, and operation sound of press button switches 35*a* to 35*f*: off) are displayed in the bottom region of the display screen 31*a*. The display section 31 can display the above display in a combination so that a portion where predetermined symbols showing time tone, alarm notification, and snooze function are shown in preset positions is displayed in a segment format, and the other portions are displayed with a dot matrix display.

Figure 2:
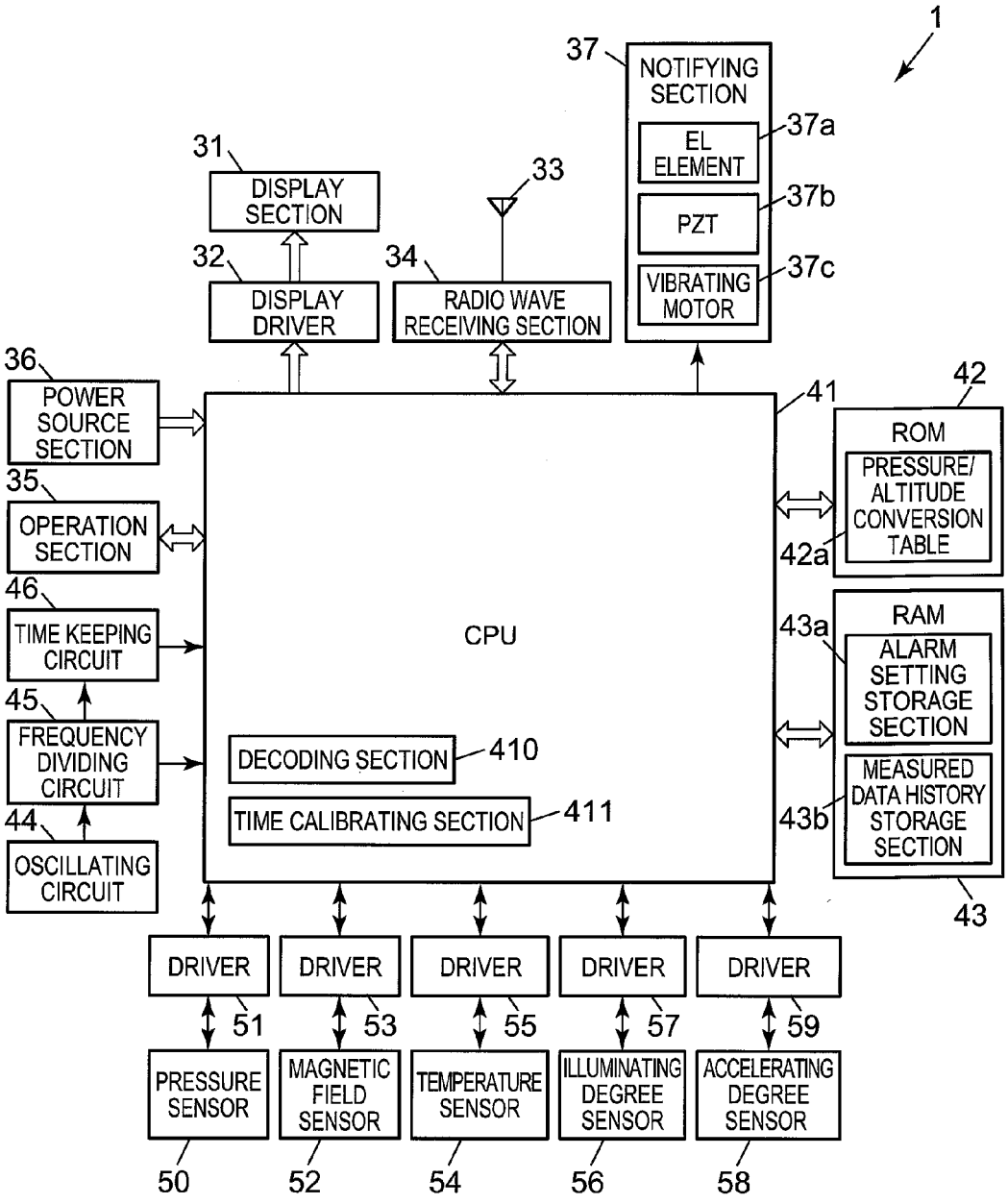
FIG. 2 is a block diagram showing an internal configuration of the electronic timepiece.

FIG. 2 is a block diagram showing an internal configuration of the electronic timepiece 1 of the present embodiment.

The electronic timepiece 1 includes a display section 31 with a display driver 32, an antenna 33 with a radio wave receiving section 34, an operation section 35, a power source section 36, a CPU (Central Processing Unit) 41 (control section), a ROM (Read Only Memory) 42, a RAM (Random Access Memory) 43, an oscillating circuit 44, a frequency dividing circuit 45, a time keeping circuit 46 (time keeping section), a notifying section 37, a pressure sensor with a driver 51, a magnetic field sensor 52 with a driver 53, a temperature sensor 54 with a driver 55, an illuminating degree sensor 56 with a driver 57, and an accelerating degree sensor 58 with a driver 59.

The display section 31 includes the above described display screen 31*a*, and displays various display such as time on the display screen 31*a*. The display section 31 switches between display/non-display of each segment or pixel of the display screen 31*a* according to driving signals input from the display driver 32 based on the control signal from the CPU 41. The display screen 31*a* can be other display types such as an organic EL (electro-luminescent) display, and the display driver 32 is provided according to the display type of the display screen 31*a*.

The radio wave receiving section 34 uses the antenna 33 to receive an amplitude modulated wave with a long wavelength band. In other words, according to the electronic timepiece 1 of the present embodiment, the radio wave receiving section 34 receives standard radio waves which output and transmit time information from countries around the world. For example, major standard radio waves include JJY of Japan (40 kHz, 60 kHz), WWVB of the United States of America (60 kHz), MSF of the United Kingdom (60 kHz), DCF 77 of Germany (77.5 kHz), and the like. The radio wave receiving section 34 selects the standard radio wave which is the target of reception based on the set city information and synchronizes with the selected frequency so as to be able to receive the standard radio wave.

The receiving section includes such antenna 33 and radio wave receiving section 34.

Figure 3A:
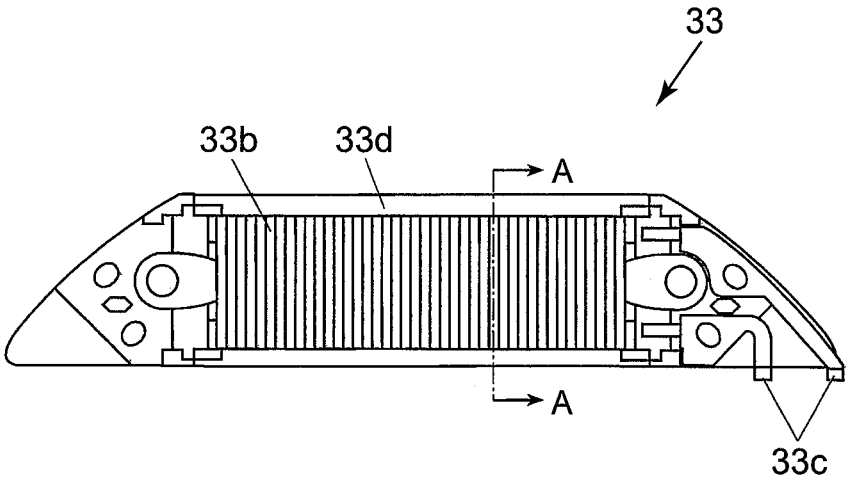
FIG. 3A and FIG. 3B are diagrams describing a configuration of an antenna.
Figure 3B:
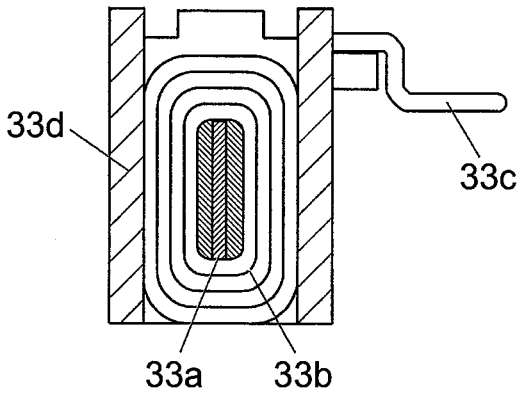

FIG. 3A and FIG. 3B are diagrams describing a shape of the antenna 33 used in the electronic timepiece 1 of the present embodiment. FIG. 3A is a planar view of the antenna 33, and FIG. 3B is a cross-sectional view of FIG. 3A along line AA.

The antenna 33 is a bar antenna suitable for receiving a radio wave with a long wavelength band. A conducting wire (winding wire) is wound around a center portion of a longitudinal direction of a core 33*a* in a long plate shape or bar shape to form the coil 33*b*. A portion or the entire side face section of the core 33*a* and the coil 33*b* is stored in a cover member 33*d*.

A magnetic material with high magnetic permeability which can be formed into a long plate shape or bar shape, for example, a ferrite core or an amorphous alloy can be used as the core 33*a*. The length of the core 33*a* is substantially the same length as the cover member 33*d*. Each end of the winding wire of the coil 33*b* is connected to a lead wire 33*c* and is pulled in a direction perpendicular to a direction that the antenna 33 extends. The coil 33*b* can be fixed to the core 33*a* or the cover member 33*d* using an insulating adhesive. For example, the cover member 33*d* uses an insulating material such as various resin, and fixes and protects the core 33*a* and the core 33*b* without influencing the reception sensitivity of the antenna 33. The position of the antenna 33 in the electronic timepiece 1 is described in detail later.

The operation section 35 detects input operation of the press button switches 35*a* to 35*f* to be converted to electric signals, and the electric signals are output to the CPU 41 as input signals. Alternatively, the operation section 35 can include a configuration to detect input operation with other methods such as a crown or a touch panel sensor.

The power source section 36 provides power to each section of the electronic timepiece 1 such as the CPU 41. The power source section 36 is small and is able to provide power stably for a long period of time. The power source section 36 is a small power source which can supply power for a long period of time stably, such as a rechargeable button type battery.

The CPU 41 performs various calculating processing and centrally controls the entire operation of the electronic timepiece 1. The CPU 41 reads from the ROM 42 programs regarding various functions according to the input signal input from the operation section 35. The CPU 41 includes a decoding section 410 and a time calibrating section 411. The decoding section 410 decodes the radio wave received by the antenna 33 and the radio wave receiving section 34 to obtain time information. The time calibrating section 411 calibrates the present time measured by a time keeping circuit 46 based on time information decoded by the decoding section 410.

The ROM 42 stores a control program, programs regarding various functions, and default setting data. The programs and default setting data are read by the CPU 41 according to necessity, and are expanded on the RAM 43 to be executed. The default setting data includes a pressure/altitude conversion table 42*a* to convert a value of measured pressure to an altitude value.

The RAM 43 provides a work memory space in the CPU 41. The RAM 43 includes a measured data history storage section 43*b* which stores temporary data such as history data of measured values measured by the pressure sensor 50, the magnetic field sensor 52, and the temperature sensor 54, and an alarm setting storage section 43*a* which stores on/off setting of the alarm function and alarm setting time information.

The CPU 41, the ROM 42, and the RAM 43 can be a configuration collectively formed on a later described control chip 62 (see FIG. 4A).

The oscillating circuit 44 is a circuit which generates and outputs a predetermined frequency signal. For example, the oscillating circuit 44 includes a crystal oscillator.

The frequency dividing circuit 45 divides and outputs a signal with a predetermined frequency input from the oscillating circuit 44 to a signal with a frequency used in the CPU 41 and the time keeping circuit 46.

The time keeping circuit 46 counts the number of times the signal is input from the frequency dividing circuit 45 and adds the number to a preset initial time to count the present time. The present time measured by the time keeping circuit 46 is read from the CPU 41 and displayed on the display section 31. It is possible to overwrite and calibrate the present time measured by the time keeping circuit 46 based on an instruction from the CPU 41 (time calibrating section 411).

The notifying section 37 includes a configuration to perform various notifications to the user of the electronic timepiece 1. According to the electronic timepiece 1, the notifying section 37 includes an EL element 37*a*, a PZT 37*b* (piezoelectric element), and a vibrating motor 37*c*. The EL element 37*a* is a planar element provided in the bottom section of the display screen 31*a* in the display section 31, and is a backlight which emits light by applying a predetermined voltage to illuminate the entire face of the display screen 31*a*. The PZT 37*b* stretches and shrinks and changes shape when a voltage is applied at a predetermined frequency to generate a buzzer sound. The PZT 37*b* can be attached to a vibrating plate and the buzzer sound may be generated efficiently by vibrating the vibrating plate. The vibrating motor 37*c* generates vibration by operation of the motor to notify the user wearing the electronic timepiece 1.

The configuration of notification is not limited to the above. For example, an LED (Light Emitting Diode) or a miniature bulb can be included as other configuration for illumination or a small speaker can be included as other configuration for emitting sound.

The pressure sensor 50 is a small sensor which measures pressure. For example, a semiconductor sensor using a piezoelectric element is used as the pressure sensor 50. The driver 51 applies a predetermined voltage to the pressure sensor 50 to obtain output voltage to be output to the CPU 41.

The magnetic field sensor 52 is a small sensor which measures the earth magnetic field. For example, a sensor using a magnetic resisting element can be used as the magnetic field sensor 52. The driver 53 applies predetermined voltage to a pair of magnetic field sensors 52 to measure a magnetic field in an orthogonal direction and amplifies the output voltage to be output to the CPU 41.

The temperature sensor 54 is a sensor which measures the temperature. Here, the temperature sensor 54 is an IC circuit provided in a control chip 62 (see FIG. 4A) together with the CPU 41, the ROM 42 and the RAM 43. It is preferable to provide the temperature sensor 54 in a position which meets the following conditions as much as possible where the temperature sensor 54 can come into contact with outside air through a hole so as to be able to measure temperature outside the electronic timepiece 1, and where the temperature sensor 54 does not receive influence of heat emitted from the electronic components in the electronic timepiece 1 and body heat from the arm of the user through the back cover. However, the CPU 41 can calibrate the obtained measured value to remove influence as described above to calculate the temperature. The driver 55 supplies a predetermined voltage to the temperature sensor 54 and outputs the output voltage to the CPU 41.

The illuminating degree sensor 56 is a sensor which measures amount of light which enters a predetermined portion of the display screen 31*a*. For example, a photodiode or a photo IC can be used as the illuminating degree sensor 56. The driver 57 applies a predetermined voltage to the illuminating degree sensor 56 to operate the illuminating degree sensor 56 and also detects whether the amount of light which enters is below a predetermined threshold level by using, for example, a comparator and outputs the detected signal to the CPU 41.

The accelerating degree sensor 58 is a sensor which can detect at least the accelerating degree of the display face of the electronic timepiece 1 and the direction perpendicular to the display face, including accelerating degree due to gravity. For example, a sensor using a piezoelectric element such as a PZT can be used as the accelerating degree sensor 58. The driver 59 supplies predetermined power to the accelerating degree sensor 58 and amplifies the output of the accelerating degree sensor 58 to be output to the CPU 41.

Next, the position of the configuration in the casing 2 of the electronic timepiece 1 is described.

According to the electronic timepiece 1 of the present embodiment, the driving control circuit is formed using one four-layer substrate 6 where four wiring layers (first layer to fourth layer) are overlapped.

Figure 4A:
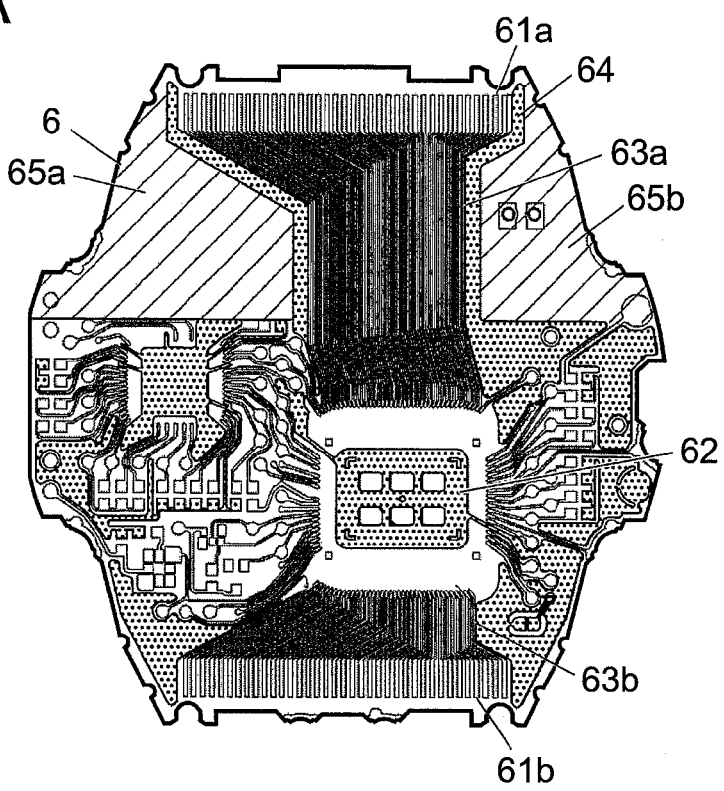
FIG. 4A and FIG. 4B are diagrams describing a substrate of the electronic timepiece.
Figure 4B:
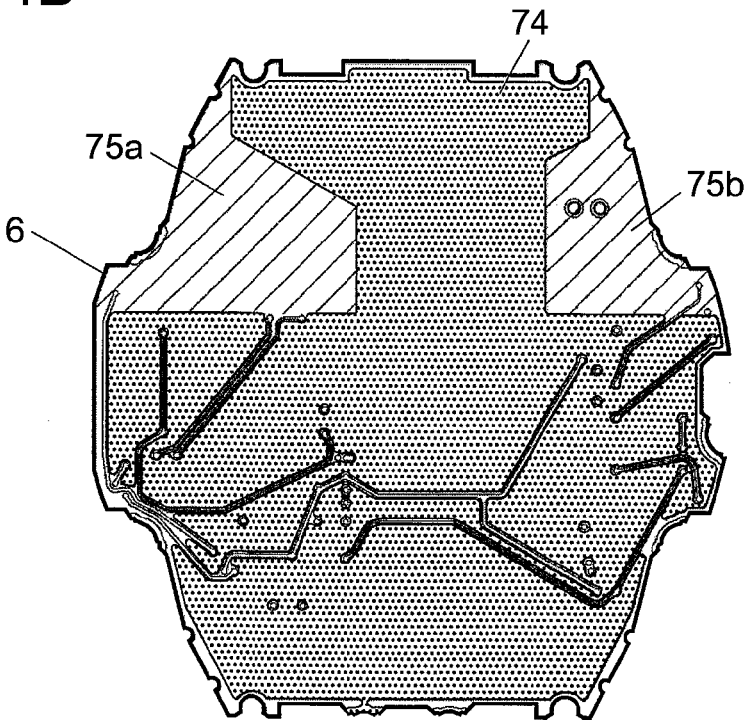
Figure 5A:
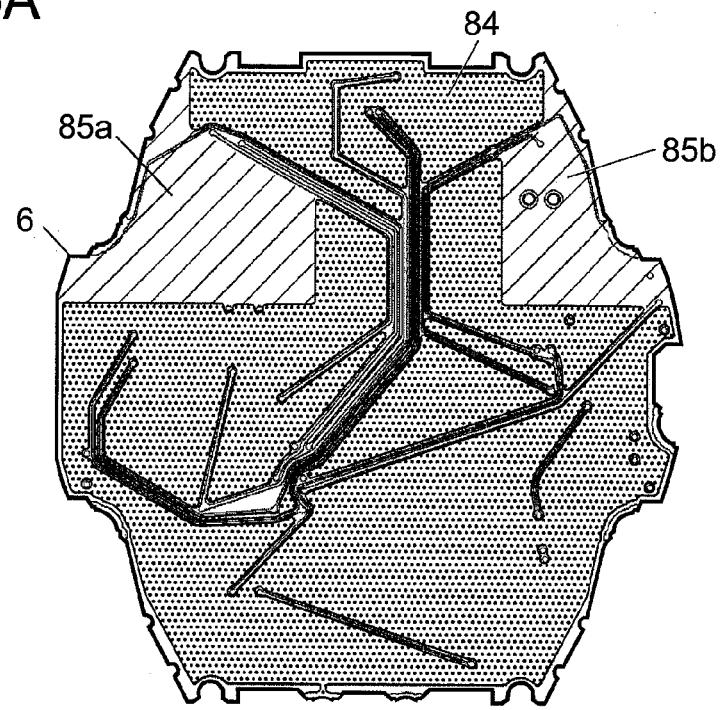
FIG. 5A and FIG. 5B are diagrams describing the substrate of the electronic timepiece.
Figure 5B:
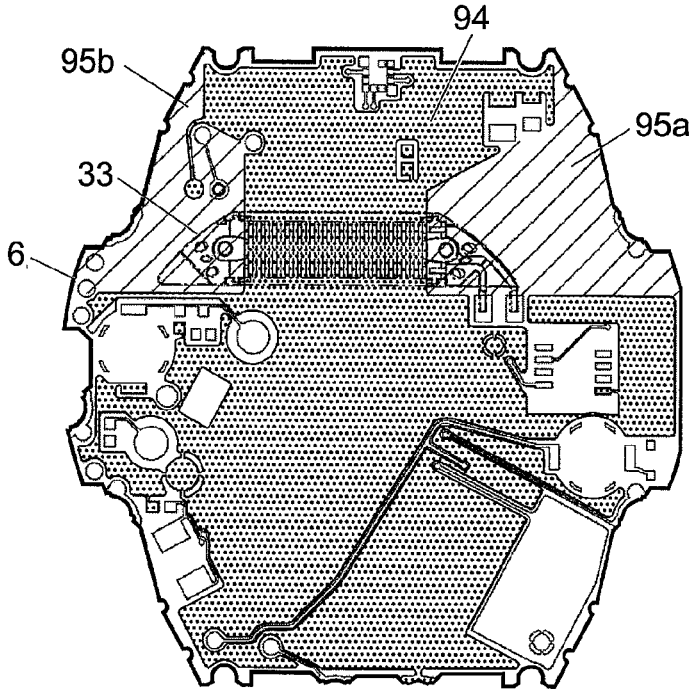

FIG. 4A, FIG. 4B, FIG. 5A, and FIG. 5B are diagrams describing a four-layer substrate 6 provided in a casing 2. FIG. 4A and FIG. 4B are diagrams showing a first layer and a second layer of a four-layer substrate 6 and FIG. 5A and FIG. 5B are diagrams describing a third layer and a fourth layer of a four-layer substrate 6.

As shown in FIG. 4A, liquid crystal connectors 61*a* and 61*b* (connecting section) connected to each input terminal of the display section 31 are provided on both edges of an outer layer on the display section 31 side in the four-layer substrate 6, in other words, the first layer (a first layer) which is the layer of the front face. Each of the terminals (output terminal) of the liquid crystal connectors 61*a* and 61*b* are connected to the control chip 62 attached to the first layer in the position between the liquid crystal connectors 61*a* and 61*b* through the liquid crystal wiring 63*a* and 63*b* (output wiring) provided on the first layer. The width of aligning the liquid crystal wiring can be smaller than the width of aligning the terminals. Therefore, the entire width of the liquid crystal wiring 63*a* is smaller than the width of the liquid crystal connectors 61*a* and 61*b*.

Here, various wiring such as the liquid crystal wiring 63*a* and 63*b* are provided on the first layer, and other than the wiring itself which are insulated and covered, the portions where electronic components are mounted are grounded (grounding region 64, solid pattern). Alternatively, non-wiring regions 65*a* and 65*b* where wiring are basically not provided are provided on both outer sides of the grounding region 64 regarding the liquid crystal wiring 63*a* and liquid crystal connector 61*a*. Such non-wiring regions 65*a* and 65*b* are covered and protected by an insulating film without being grounded.

FIG. 4B is a diagram of the second layer (inner layer provided on the display section 31 side) of the four-layer substrate 6 viewed from the first layer side with the first layer transparent. On the second layer, from a planar view of the four-layer substrate 6, a grounding region 74 and non-wiring regions 75*a* and 75*b* are provided in positions corresponding to the grounding region 64 and the non-wiring regions 65*a* and 65*b* in the first layer as shown in FIG. 4A. Some wiring which connect the control chip 62 and other electronic components provided on the first layer side of the four-layer substrate 6 to the other side are provided in the grounding region 74. However, most of the region including the region between the non-wiring regions 75*a* and 75*b* are in a grounded state.

The third layer is an inner layer provided on a side of the second layer opposite of the first layer substantially parallel to the second layer and separated a predetermined distance from the second layer. FIG. 5A is a planar diagram viewing the third layer from the first layer side with the other layers transparent. On the third layer, from a planar view of the four-layer substrate 6, a grounding region 84 and non-wiring regions 85*a* and 85*b* are provided in positions corresponding respectively to the grounding regions 64 and 74 and non-wiring regions 65*a*, 65*b*, 75*a*, and 75*b* provided on the first layer and the second layer. The grounding region 84 is provided with wiring for connecting components (for example, various sensors) which need a certain amount of space or which are desired to be positioned separated from other electronic components on the first layer (outer layer).

According to the electronic timepiece 1 of the present embodiment, due to the position of the press button switch 35*a*, a small portion of wiring for transmitting input signals regarding the operation of the press button switch 35*a* is provided in the non-wiring region 85*a*.

FIG. 5B shows a planar diagram (base diagram) viewing from the back cover side the fourth layer (a second layer) which is the outer layer on the back cover side. On the fourth layer, from a planar view of the four-layer substrate 6, a grounding region 94 (shielding region) and non-wiring regions 95*a* and 95*b* are provided in positions corresponding to the grounding region 84 and non-wiring regions 85*a* and 85*b*. In the grounding region 94, electronic components connected by wiring provided on the above described third layer and some of the wiring are provided in a position separated from the antenna 33. However, most of the region including the region in between the non-wiring regions 95*a* and 95*b* are in a grounded state.

On the fourth layer, both edges of the antenna 33 are fixed in the non-wiring regions 95*a* and 95*b* (both edge regions). In other words, the antenna 33 is attached to the fourth layer crossing a portion corresponding to the position of the liquid crystal wiring 63*a* in the grounding region 94 between the non-wiring regions 95*a* and 95*b*. The lead wire 33*c* of the antenna 33 is connected to wiring (signal wire) in the grounding regions 84 and 94 to output receiving radio wave signals to the radio wave receiving section 34.

Described below are the advantages of providing both edges of the antenna 33 (core 33*a*) in the non-wiring regions 95*a* and 95*b*, and providing the grounding regions 74 and 94 between the center section of the antenna 33 and the wiring of the first layer to the third layer as described above.

In the antenna 33, the change in the magnetic wire which passes between the two edges of the core 33*a*, in other words, the change of the magnetic flux which penetrates the coil 33*b* causes an induced current in the coil 33*b* to be obtained as the receiving radio wave signal. Therefore, it is possible to prevent the change of the magnetic flux passing through the core 33*a* from attenuating by positioning non-wiring portions where wiring and electronic components are basically not provided in portions of the first layer to the fourth layer corresponding to portions of both edges of the antenna 33 in the four-layer substrate 6 so that both edges of the core 33*a* are separated from conducting members. Moreover, due to the above configuration, the change in the extending direction of the antenna 33 among the changes of the magnetic field regarding the electromagnetic noise caused in the electronic components and wiring on the four-layer substrate 6 does not reach both edges of the antenna 33.

Most of the portions of the second layer and the fourth layer corresponding to the portions where the wiring and the electronic components are provided on the first layer and the third layer are grounded as the grounding regions 74 and 94. Therefore, this functions as the shielding region so that most of the noise emitted to the surrounding portions from the wiring and electronic components do not reach the antenna 33. With this, the center portion of the core 33*a* of the antenna 33 is shielded from the standard radio wave. However, the standard radio wave entering both edges of the core 33*a* from a far distance is not blocked. The influence of the attenuation of the radio wave entering intensity to the center portion of the core 33*a* is small compared to the attenuation of the radio wave entering intensity to both edges of the core 33*a*. Therefore, the reception sensitivity is not largely attenuated.

Therefore, according to the above position, it is possible to prevent the reception sensitivity of the standard radio wave from reducing in the antenna 33 as a whole, while reducing the reception level of noise generated in the electronic timepiece 1.

Figure 6A:
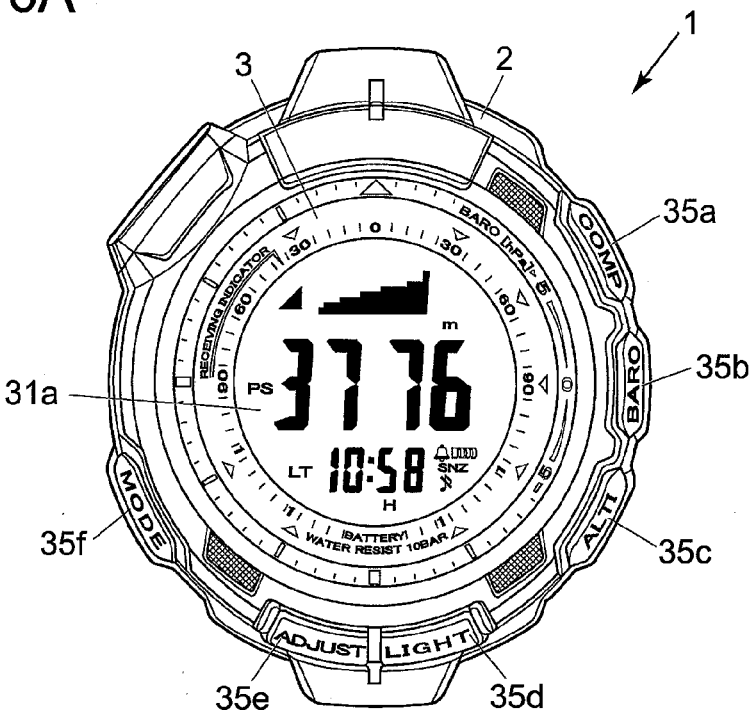
FIG. 6A and FIG. 6B are diagrams showing an example of display on a display screen of the electronic timepiece.
Figure 6B:
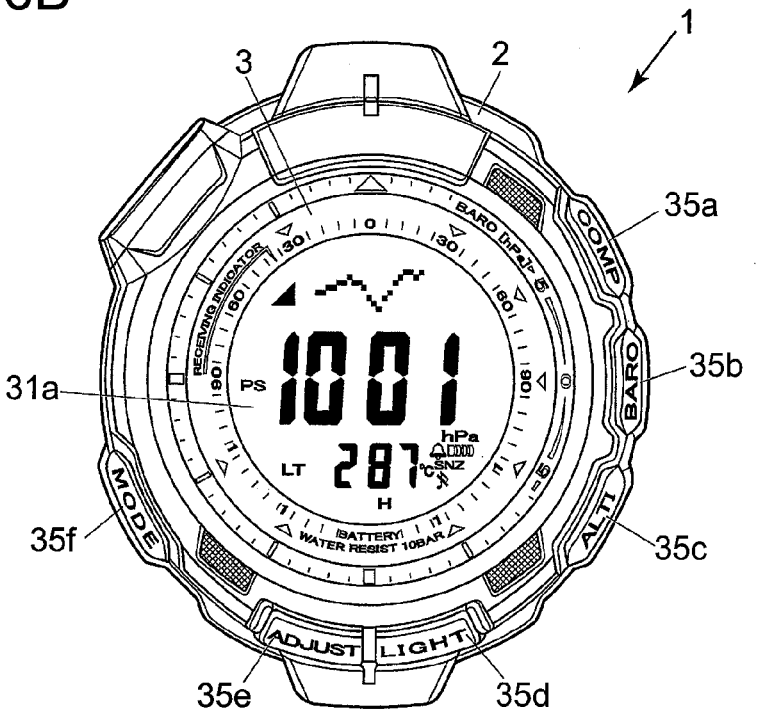
Figure 7:
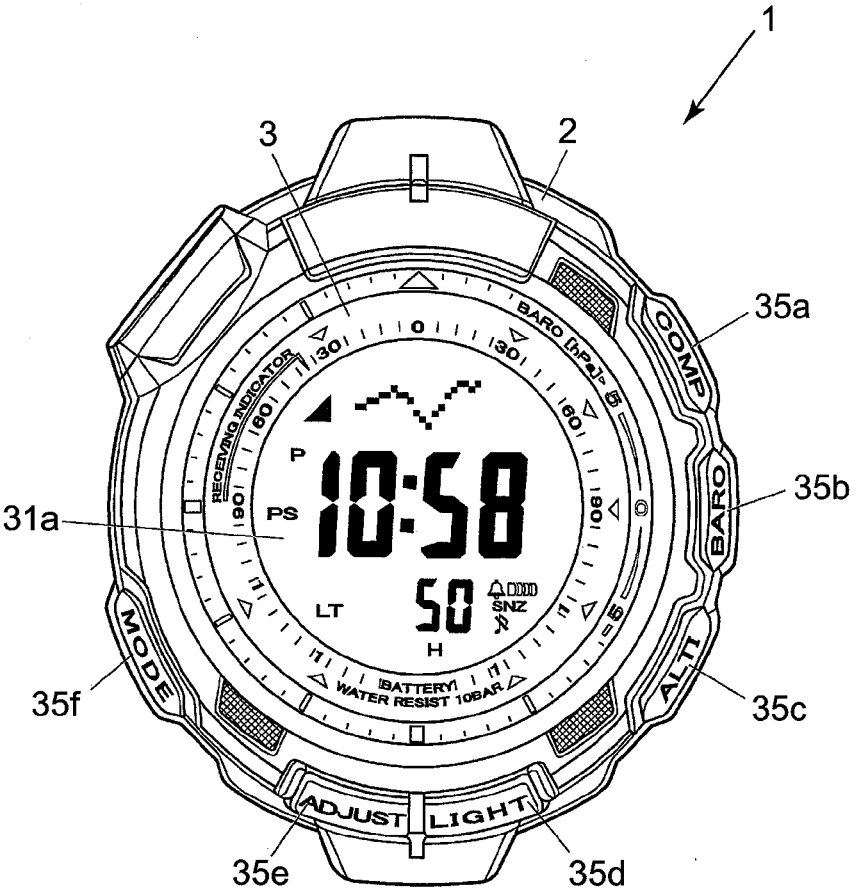
FIG. 7 is a diagram showing an example of display on the display screen of the electronic timepiece.

FIG. 6A, FIG. 6B, and FIG. 7 show an example of a display of the display screen 31*a* of the electronic timepiece 1.

FIG. 6A shows a display example of the display screen 31*a* in an altitude display state. When the press button switches 35*e* and 35*f* are pressed and the mode is switched to the altitude display state, a value of the altitude calculated based on the measured value of the pressure sensor 50 and the pressure/altitude conversion table 42*a* is displayed at a maximum of four digits in the middle region of the display screen 31*a*, and a display "m" showing the unit of display "meter" is displayed above the value of the ones place. Moreover, the mode advances to the altitude display state for a predetermined amount of time by pressing the press button switch 35*c*.

Here, in the electronic timepiece 1 of the present embodiment, at the same time, the history of the change of altitude can be displayed as a graph in the upper region of the display screen 31*a* and the present time can be displayed in the lower region of the display screen 31*a*.

FIG. 6B shows a display example of the display screen 31*a* in a state of displaying the pressure or the temperature. When the press button switches 35*e* and 35*f* are pressed and the mode is switched to the state of displaying the pressure or the temperature, based on the measured value of the pressure sensor 50, the pressure is displayed at a maximum of four digits in the middle region of the display screen 31*a* and the display "hPa" showing the unit of display (hectopascal) is displayed below the value of the ones place. Moreover, in the lower region of the display screen 31*a*, based on the measured value of the temperature sensor 54, the temperature is displayed with all of the following at most, a symbol "-", two digits of integer number digits, decimal point ".", and one digit of decimal number digit. The display "° C." showing the unit of display (here, Celsius) is displayed on the right side of the decimal number digit.

Here, the history of the change of the pressure can be displayed as a graph in the upper section of the display screen 31*a*.

FIG. 7 is another display example of the display screen 31*a* of the electronic timepiece 1.

In the display example, only the history of the pressure change is displayed in the upper region while the time is displayed in the middle region and the lower region of the display screen 31*a*.

As described above, by employing the position of the antenna as described above, it is possible to make the display screen 31*a* larger compared to the planar size of the electronic timepiece 1, and it is possible to increase the number of pixels of the display and the number of segments so as to be able to flexibly combine a plurality of displays to be displayed at the same time.

As described above, the electronic timepiece 1 of the present embodiment includes, the display section 31 to execute digital display, one four-layer substrate 6 in which four wiring layers are overlapped in a thickness direction, the control chip 62 attached to the first layer of the four-layer substrate 6, liquid crystal connectors 61*a* and 61*b* which are attached to the first layer and which are provided with a plurality of terminals connected to the display section 31, the antenna 33 and the radio wave receiving section 34, and the liquid crystal wiring 63*a* and 63*b* which connect each of the plurality of terminals of the liquid crystal connectors 61*a* and 61*b* with the control chip 62 on the first layer. From a planar view of the four-layer substrate 6, the antenna 33 is attached to the position between the positions corresponding to the control chip 62 and the liquid crystal connector 61*a* on the fourth layer which is the outer layer on the side opposite of the first layer. On the first layer, the liquid crystal wiring 63*a* is provided so as to pass between the positions corresponding to both edges of the antenna 33. On the fourth layer, most of the portions between both edges of the antenna 33 is to be the grounding region 94. Since it is possible to make the width of the liquid crystal connectors 61*a* and 61*b* wide while reducing the noise the antenna 33 receives from the wiring and the electronic components on the four-layer substrate 6, it is possible to provide a wide and highly clear display screen 31*a* compared to the planar size of the electronic timepiece 1 while receiving radio waves well.

Moreover, from a planar view of the four-layer substrate 6, on the first layer to the fourth layer, a predetermined range each including a portion corresponding to both edges of the antenna 33 are to be the non-wiring regions 65*a*, 65*b*, 75*a*, 75*b*, 85*a*, 85*b*, 95*a*, and 95*b*. Therefore, it is possible to separate the conductive material from both edges which greatly influence the reception sensitivity of the antenna 33 and it is possible to prevent reduction of reception sensitivity.

Since the antenna 33 is positioned in a position separated from the circular casing 2 which is a conductive material, in addition to preventing reduction of the reception sensitivity due to influence of the wiring and the electronic components, it is possible to prevent reduction of the reception sensitivity due to influence of the casing 2.

By using a four-layer substrate 6 and attaching the antenna 33 to the fourth layer which is not adjacent to the first layer where the control chip 62 and the liquid crystal wiring 63*a* and 63*b* are provided, it is possible to separate the antenna 33 at a large distance from the electronic components and the wiring. Moreover, it is possible to effectively reduce reception of noise from the electronic components and the wiring by the grounding region 74 provided on the second layer and the grounding region 94 provided on the fourth layer. Further, when a large number of sensors such as a magnetic field sensor 52 are provided, it is possible to provide the control chip, the wiring, the sensor, and the antenna 33 spaciously separated.

The grounding regions 74 and 94 prevent the noise from the electronic components and wiring of the first layer from being detected by the antenna 33. Therefore, it is possible to suitably balance between ease of the configuration and the reduction of the sensitivity.

The antenna 33 and the liquid crystal wiring 63*a* are provided in a position orthogonal at a planar view. Therefore, it is possible to provide many liquid crystal wiring 63*a* effectively in a limited width. Moreover, it is possible to effectively reduce the elements in the parallel direction of the antenna 33 which influence the reception sensitivity included in the noise caused from the liquid crystal wiring 63*a*.

The electronic timepiece 1 of the present embodiment employs positioning of components and wiring using the above described four-layer substrate 6 where it is possible to decode time information from the standard radio wave received by the radio wave receiving section 34 to obtain the time information and to calibrate the time of the timekeeping circuit 46 using the obtained time information. Therefore, it is possible to obtain a radio controlled timepiece which can obtain the time information well and in which it is possible to provide a large and highly clear display screen.

The present invention is not limited to the above described embodiments, and various modifications can be made.

For example, according to the present embodiment, the four-layer substrate 6 is used, and the liquid crystal connectors 61*a* and 61*b*, the control chip 62, and the liquid crystal wiring 63*a* and 63*b* which connect the above are provided on the first layer, whereas the antenna 33 is provided on the fourth layer. However, it is possible to use two double sided substrates to configure four wiring layers as a whole.

Moreover, the present invention can be applied to a two-layer configuration using one double sided substrate. In other words, it is possible to achieve the effects similar to the present invention by providing the liquid crystal connectors 61*a* and 61*b*, the control chip 62, and the liquid crystal wiring 63*a* and 63*b* connecting the above on the front face of a substrate and providing the antenna 33 on the rear face of the substrate.

Alternatively, in a case using a multi-layer substrate other than four layers, using three or more double-sided substrates or one-sided substrates, or using two or more combinations of a multi-layer substrate, a double-sided substrate and a one-sided substrate, by attaching the antenna 33 to either layer of the edges among the plurality of wiring layers overlapped by the above substrates, for example, in a multi-layer substrate by attaching the antenna 33 to an outer layer where the control chip 62 is not attached, it is possible to effectively prevent reception of noise from electronic components such as the control chip 62, the liquid crystal wiring 63*a* and 63*b*, and wiring provided in other layers. The control chip 62 can be attached to the wiring layer embedded in the multi-layer substrate according to various conditions such as positions of other electronic components and wiring, as long as a shielding region is provided between the antenna 33.

According to the above described embodiments, the antenna 33 is shorter than the liquid crystal connectors 61*a* and 61*b*. However, when a circular casing 2 is used, in addition to the liquid crystal connectors 61*a* and 61*b*, the antenna 33 can be made long at the same time by providing the antenna 33 towards the center. With this, it is also possible to enhance sensitivity of the antenna 33.

The shape of the non-wiring regions 65*a* and 65*b* is not limited to the shape as described in the above described embodiment. For example, the shape can be suitably changed according to the position of the press button switches, various sensors, and the wiring which connect the above.

According to the above embodiment, the grounding regions 74 and 94 are used as the magnetic shielding section against internal noise. However, other magnetic shielding members can be used as long as the reception sensitivity of the antenna 33 does not become greatly worse.

According to the above embodiment, the standard radio wave is received by the electronic timepiece which is a watch including a digital display screen, however, the embodiment of the present invention is not limited to the above. For example, the present invention may be used in a small portable timepiece other than a watch. The technique of the present invention can also be applied to an electronic device other than a timepiece, for example a receiver which receives a beacon in a long wavelength band, a radio receiver which receives broadcast radio waves in a medium wavelength band with a bar antenna, and the like.

Specific detailed points of the present embodiment such as the shape of the four-layer substrate 5, the casing 2, and the display screen 31*a* can be suitably changed without leaving the scope of the present invention.

Although various exemplary embodiments have been shown and described, the invention is not limited to the embodiments shown. Therefore, the scope of the invention is intended to be limited solely by the scope of the claims that follow and its equivalents.

The entire disclosure of Japanese Patent Application No. 2013-027210 filed on Feb. 15, 2013 including specification, claims, drawings and abstract are incorporated herein by reference in its entirety.

What is claimed is:

1. An electronic device comprising:

a display section which executes digital display;

at least one substrate which is positioned below the display section, the at least one substrate comprising one substrate or a plurality of substrates arranged in a thickness direction, the one substrate or the plurality of substrates including a plurality of wiring layers overlapped as a whole;

a control section which is attached to a first layer among the plurality of wiring layers and which controls display of the display section;

a connecting section which is provided on the first layer and in which a plurality of output terminals connected to the display section are arranged;

a receiving section which includes a bar antenna to receive a radio wave, wherein the bar antenna is provided on a surface of the substrate on a side opposite to the display section; and output wiring which is provided on the first layer and which connects each of the plurality of the output terminals and the control section, wherein:

from a planar view of the substrate, the bar antenna is attached on a face of a second layer on a side opposite to the first layer, in a position between positions corresponding to positions of the connecting section and the control section, the second layer being a wiring layer of either edge layer of the plurality of wiring layers and which is different from the first layer;

the output wiring connected to the connecting section and the output terminals is provided on the first layer so as not to cross regions corresponding to both edge regions including both edges of the bar antenna and so as to cross between said both edge regions; and the region between said both edge regions on the second layer is a shielding region provided with a magnetic shielding section.

2. The electronic device according to claim 1, wherein, from a planar view of the substrate, a non-wiring region where wiring is not provided is provided on all of the wiring layers in a predetermined portion including the region corresponding to said both edge regions.

3. The electronic device according to claim 2, wherein:

the substrate includes at least three layers of the wiring layer; and from a planar view of the substrate, a magnetic shielding section is provided in a region corresponding to the shielding region in at least one wiring layer in a wiring layer between the first layer and the second layer.

4. The electronic device according to claim 3, wherein the shielding region is a grounding region.

5. The electronic device according to claim 4, wherein, from a planar view of the substrate, the bar antenna is attached to the second layer so as to be orthogonal to the output wiring.

6. The electronic device according to claim 3, wherein, from a planar view of the substrate, the bar antenna is attached to the second layer so as to be orthogonal to the output wiring.

7. The electronic device according to claim 3, further comprising a time keeping section which counts present time, wherein:

the radio wave received by the receiving section is a radio wave including time information, the control section includes:

a decoding section which obtains time information from the received radio wave; and a time calibrating section which calibrates the present time counted by the time keeping section based on time information decoded by the decoding section, and the control section continuously displays the present time on the display section.

8. The electronic device according to claim 2, wherein the shielding region is a grounding region.

9. The electronic device according to claim 8, wherein, from a planar view of the substrate, the bar antenna is attached to the second layer so as to be orthogonal to the output wiring.

10. The electronic device according to claim 2, wherein, from a planar view of the substrate, the bar antenna is attached to the second layer so as to be orthogonal to the output wiring.

11. The electronic device according to claim 2, further comprising a time keeping section which counts present time, wherein:

the radio wave received by the receiving section is a radio wave including time information, the control section includes:

a decoding section which obtains time information from the received radio wave; and a time calibrating section which calibrates the present time counted by the time keeping section based on time information decoded by the decoding section, and the control section continuously displays the present time on the display section.

12. The electronic device according to claim 1, wherein:

the substrate includes at least three layers of the wiring layer; and from a planar view of the substrate, a magnetic shielding section is provided in a region corresponding to the shielding region in at least one wiring layer in a wiring layer between the first layer and the second layer.

13. The electronic device according to claim 12, wherein the shielding region is a grounding region.

14. The electronic device according to claim 13, wherein, from a planar view of the substrate, the bar antenna is attached to the second layer so as to be orthogonal to the output wiring.

15. The electronic device according to claim 12, wherein, from a planar view of the substrate, the bar antenna is attached to the second layer so as to be orthogonal to the output wiring.

16. The electronic device according to claim 12, further comprising a time keeping section which counts present time, wherein:

the radio wave received by the receiving section is a radio wave including time information, the control section includes:

a decoding section which obtains time information from the received radio wave; and a time calibrating section which calibrates the present time counted by the time keeping section based on time information decoded by the decoding section, and the control section continuously displays the present time on the display section.

17. The electronic device according to claim 1, wherein the shielding region is a grounding region.

18. The electronic device according to claim 17, wherein, from a planar view of the substrate, the bar antenna is attached to the second layer so as to be orthogonal to the output wiring.

19. The electronic device according to claim 1, wherein, from a planar view of the substrate, the bar antenna is attached to the second layer so as to be orthogonal to the output wiring.

20. The electronic device according to claim 1, further comprising a time keeping section which counts present time, wherein:

the radio wave received by the receiving section is a radio wave including time information, the control section includes:

a decoding section which obtains time information from the received radio wave; and a time calibrating section which calibrates the present time counted by the time keeping section based on time information decoded by the decoding section, and the control section continuously displays the present time on the display section.

21. The electronic device according to claim 1, further comprising a narrowing section in which an entire width of the output wiring is arranged narrower than a width of the connecting section, wherein the bar antenna is positioned to cross a portion corresponding to the narrowing section.

* * * * *